US006749412B2

(12) United States Patent
Narasipura et al.

(10) Patent No.: US 6,749,412 B2
(45) Date of Patent: Jun. 15, 2004

(54) CHECK VALVE RETAINER FOR A SCROLL COMPRESSOR

(75) Inventors: Sudarshan K. Narasipura, Arkadelphia, AR (US); Robert C. Witham, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/211,900

(22) Filed: Aug. 2, 2002

(65) Prior Publication Data

US 2004/0022658 A1 Feb. 5, 2004

(51) Int. Cl.[7] ..... F04C 18/04; B21D 51/16; B21K 1/20

(52) U.S. Cl. ..... 418/55.1; 418/270; 29/888.022; 29/890.13; 29/890.132

(58) Field of Search ..... 418/55.1, 270; 137/533, 533.17; 29/521, 522.1, 523, 888.022, 890.13, 890.132

(56) References Cited

U.S. PATENT DOCUMENTS

| | | | | | |
|---|---|---|---|---|---|
| 2,319,546 | A | * | 5/1943 | Insley et al. | 29/888.061 |
| 3,055,086 | A | * | 9/1962 | Hoganson | 29/890.13 |
| 5,341,566 | A | * | 8/1994 | Quitschau et al. | 29/890.13 |
| 6,027,321 | A | * | 2/2000 | Shim et al. | 418/55.1 |
| 6,179,589 | B1 | * | 1/2001 | Bass et al. | 418/270 |

FOREIGN PATENT DOCUMENTS

| | | | | |
|---|---|---|---|---|
| JP | 3-242483 | * | 10/1991 | 418/270 |
| JP | 5-272472 | * | 10/1993 | 418/55.1 |

* cited by examiner

*Primary Examiner*—John J. Vrablik
(74) *Attorney, Agent, or Firm*—Carlson, Gaskey & Olds

(57) ABSTRACT

A check valve retainer for a scroll compressor includes a retaining lip that fits into a recess formed in a scroll. The retaining lip may be manufactured as an integral part of the check valve retainer for press fitting or may be formed by an expansion fit locking member having a protrusion that forces a portion of check valve retainer wall into the recess. The retaining lip ensures that the check valve retainer stays attached to the scroll without risking scroll deformation.

2 Claims, 4 Drawing Sheets

CHECK VALVE RETAINER FOR A SCROLL COMPRESSOR

TECHNICAL FIELD

The invention relates to scroll compressors, and more particularly to a retainer structure for a compressor check valve.

BACKGROUND OF THE INVENTION

Scroll compressors are widely used in refrigerant compression applications. A scroll compressor typically includes two interfitting scroll members. Each scroll member has a base with a generally spiraling scroll wrap extending from the base. The wraps interfit to define a plurality of compression chambers. One scroll member acts as a non-orbiting scroll member and maintains a fixed position while the other scroll member acts as an orbiting scroll member and rotates relative to the non-orbiting scroll member. The relative rotation causes the wrap in the orbiting scroll member to orbit relative to the wrap in the non-orbiting scroll member, changing the volume of the compression chambers. This changing volume compresses refrigerant trapped in the compression chambers.

When the compressor is shut down residual pressure caused by compressed gas trapped between the wraps and contained within other compressor components, such as in a discharge plenum, discharge lines and/or a condenser, may drive the orbiting scroll in a reverse direction. This reverse rotation may continue until pressures on the high pressure side of the system equalize with pressures on the low pressure side of the system. This prolonged reverse rotation is undesirable.

To minimize or prevent reverse rotation from occurring, scroll compressors often have a check valve that moves between an open position and a closed position. The check valve opens when the compressor is compressing refrigerant, but quickly closes when the compressor shuts down. The check valve therefore prevents the flow of compressed refrigerant back into the compressor chambers upon shutdown, limiting the amount of trapped gas communicating with the compression chambers and reducing the occurrence of reverse rotation.

If the check valve is a disc-type check valve, a check valve retainer keeps in the check valve within a discharge cavity. The check valve retainer may be held in the non-orbiting scroll member via an interference fit, but interference fits often require precise tolerances to ensure proper seating of the check valve. If there is too little interference between the check valve and the bore, the check valve retainer tends to unseat itself, but too much interference may cause distortion of the non-orbiting scroll.

There is a desire for a check valve retainer structure that reliably fits into the non-orbiting scroll.

SUMMARY OF THE INVENTION

Accordingly, the present invention is directed to a scroll compressor having a check valve retainer with a retaining lip that keeps the check valve retainer in a scroll. The retaining lip fits into a recess formed on an inner wall of a discharge cavity in the scroll. To attach the check valve retainer to the scroll, an expansion fit locking member having a protrusion forces a portion of check valve retainer wall into the recess. The retaining lip ensures that the check valve retainer stays attached to the scroll without risking scroll deformation.

In an alternative embodiment, the retaining lip is manufactured as an integral part of the check valve retainer. The check valve retainer is then press fit into the scroll, allowing the retaining lip to flow into the recess. Other possible embodiments include separate locking devices that wedge the retainer into the scroll.

DETAILED DESCRIPTION OF THE EMBODIMENTS

Figure 1:
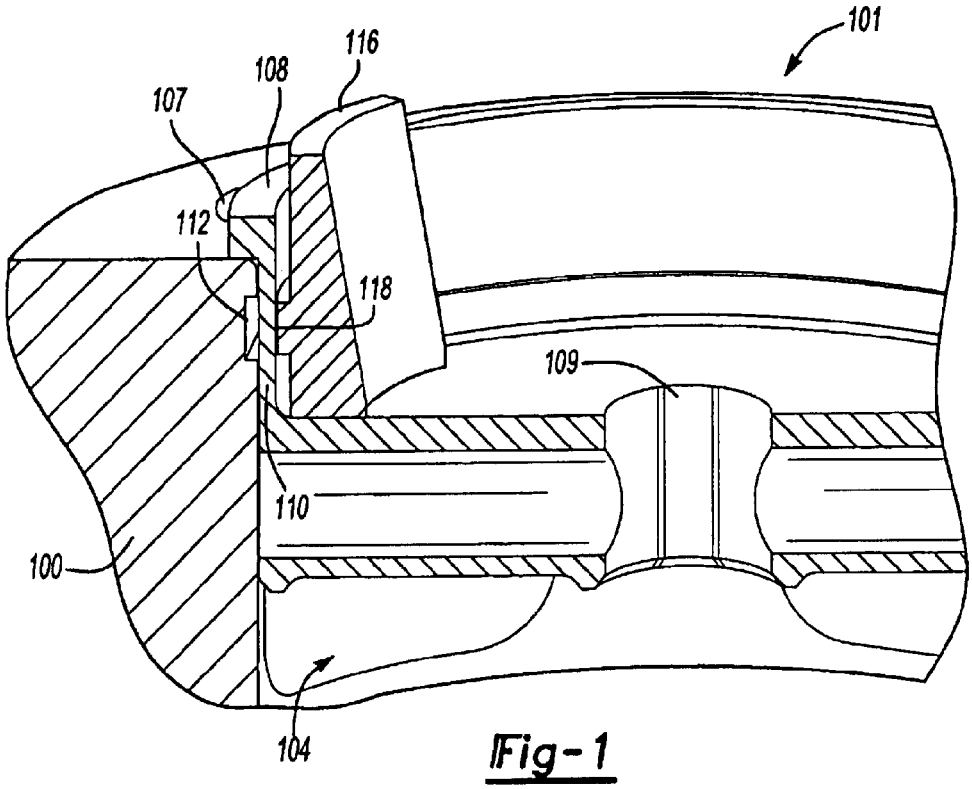
FIG. 1 illustrates a portion of a scroll compressor incorporating one embodiment of the check valve retainer before full assembly.
Figure 2:
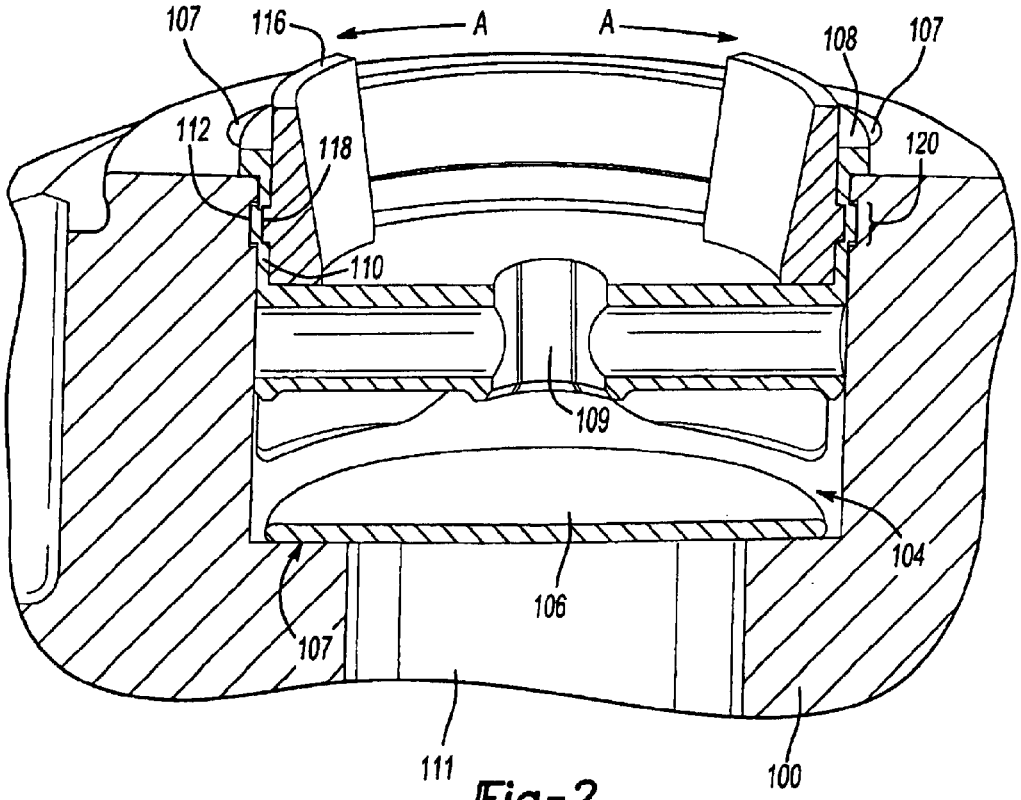
FIG. 2 illustrates the check valve retainer in FIG. 1 after full assembly.
Figure 8:
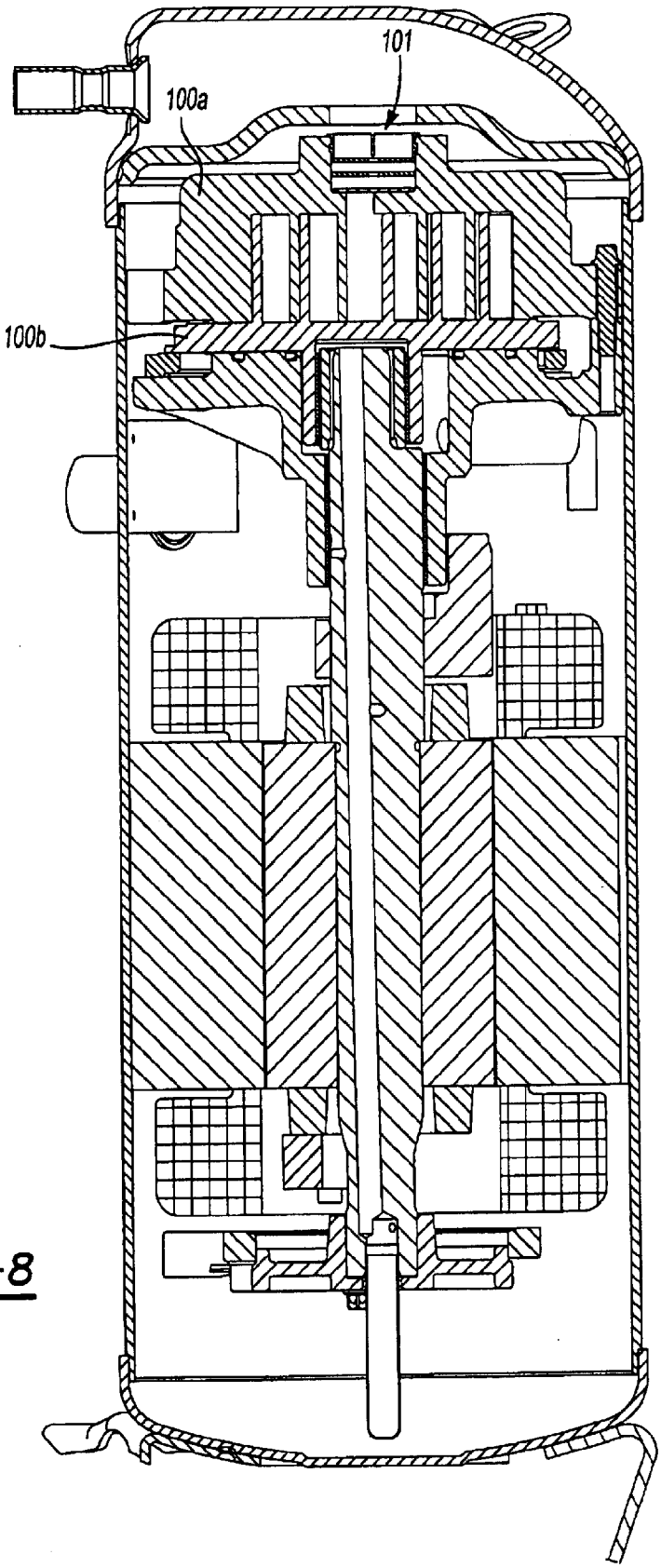
FIG. 8 illustrates a scroll in which the check valve retainer may be incorporated.

FIGS. 1 and 2 illustrate a scroll 100*a* incorporating a check valve retaining structure 101 according to one embodiment of the invention. FIG. 8 illustrates an operating environment of the check valve retaining structure; as shown in FIG. 8, the check valve retaining structure is disposed in the fixed scroll 100*a* while an orbiting scroll 100*b* orbits within the fixed scroll 100*a*. As shown, the non-orbiting scroll 100 has a discharge cavity 104. A check valve assembly includes a valve member, such as a check valve disc 106, which is disposed in the cavity 104 and seated on a valve seat 107, and a check valve retainer 108 having an outlet port 109 and side walls 110. During compressor operation, the check valve disc 106 prevents return flow of compressed gas within the compressor and therefore limits reverse orbital movement of the orbiting scroll member.

More particularly, the check valve disc 106 moves up and down within the discharge cavity 104, thereby opening and closing a discharge port 111, due to gas pressure differences between the discharge port 111 and the discharge cavity 104. As gas pushes the check valve disc 106 upward in the discharge cavity 104, the disc 106 stops against retainer 108 and gas escapes through the discharge port 111 around the edges of the check valve disc 106 and openings 107 around the edge of the retainer 108. When the compressor shuts down, gas rushes through the outlet port 109 and forces the check valve disc 106 back down to the valve seat 107.

In the embodiment shown in FIGS. 1 and 2, a recess 112 is formed into an inner wall of the discharge cavity 104 and the check valve retainer 108 is slip-fitted into the cavity 104. The recess 112 may be formed via any manufacturing process, such as cutting or coining. Further, although the Figures illustrate a recess 112 having a rectangular cross-section, the recess 112 may have any desired cross section, such as triangular, curved, etc.

A locking member 116 having a protrusion 118 formed around its outer surface is placed inside the check valve retainer 108 so that the side walls 110 of the check valve retainer 108 are sandwiched between the inner wall of the discharge cavity 104 and the locking member 116. As shown in FIG. 1, the recess 112 and protrusion 118 align with each other, trapping a portion of the check valve retainer side wall 110 therebetween. The locking member 116 preferably is an expansion fit component designed to expand when a mandrel, power screw, hydraulic tool, or other similar tool (not shown) is pushed into the component.

As shown in FIG. 2, forcing a mandrel into the locking member 116 expands the locking structure 116 outward as shown by arrows A, pushing the protrusion 118 outward toward the recess 112. During expansion, the protrusion 118 pushes against and deforms the check valve retainer side wall 110, forcing a portion of the side wall 110 into the recess 112 to form a retaining lip 120 that holds the check valve retainer 108 within the discharge cavity 104. For this embodiment, the check valve retainer 108 preferably is made of a deformable material that can flow into the recess 112 while maintaining sufficient strength to hold the retainer 108 in the cavity 104.

Although FIGS. 1 and 2 illustrate forming the retaining lip 120 in the check valve retainer using an expansion fit locking member 116, any other structures (e.g., clips, expanding coils, etc.) may act as the locking member 116 without departing from the scope of the invention.

Figure 3:
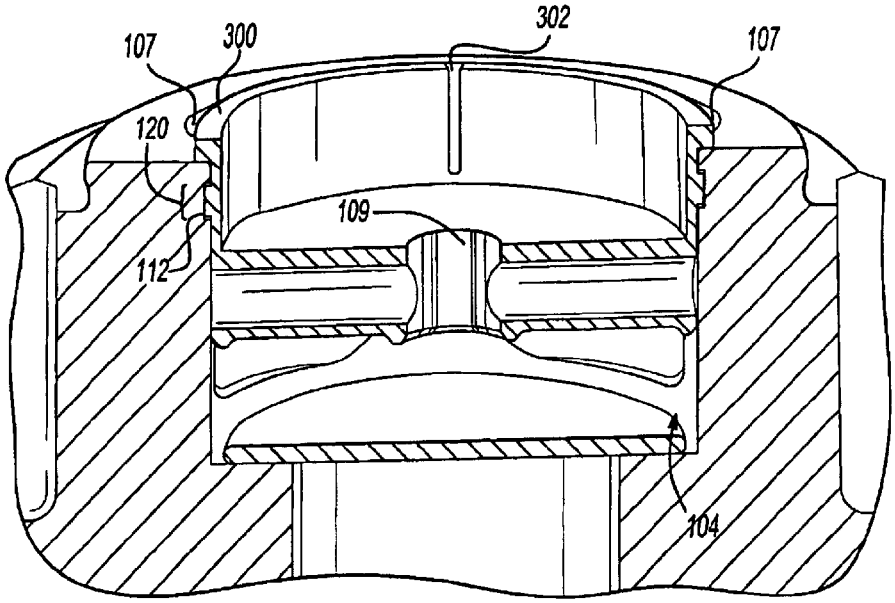
FIG. 3 illustrates another embodiment of the inventive check valve retainer.

FIG. 3 illustrates a non-orbiting scroll incorporating a check valve retaining structure according to another embodiment of the invention. In this embodiment, the check valve retainer 300 has a retaining lip 120 integrally formed around at least a portion of its circumference. Because the retaining lip 120 is already manufactured into the check valve retainer 300, this embodiment does not require a separate locking member to form the lip 112 and lock the check valve retainer 300 in place. Instead, the check valve retainer 300 in this embodiment is simply press-fitted into the discharge cavity 104 so that the retaining lip 120 snaps into the recess 112 automatically. One or more splits 302 cut into the check valve retainer 300 allows the retainer 300 to deform slightly as it is pressed into the discharge cavity and spring back into its proper shape when the retainer 300 reaches the correct depth to allow the lip 120 to engage with the recess 112. The check valve retainer 300 material preferably has some resilience so that the check valve retainer 300 can slip into the cavity 104 while still providing enough outward force to keep the retaining lip 120 securely in the recess 112.

Note that other possible engagement structures may be incorporated into the check valve retainer and the recess without departing from the scope of the invention. For example, the retaining lip 120 and the recess 112 may be threaded to stop the retainer when it is at a desired orientation within the cavity 104. Further, the recess 112 does not need to be one continuous recess 112, but may instead be a series of short grooves or dimples encircling the inner wall of the cavity 104.

Figure 4:
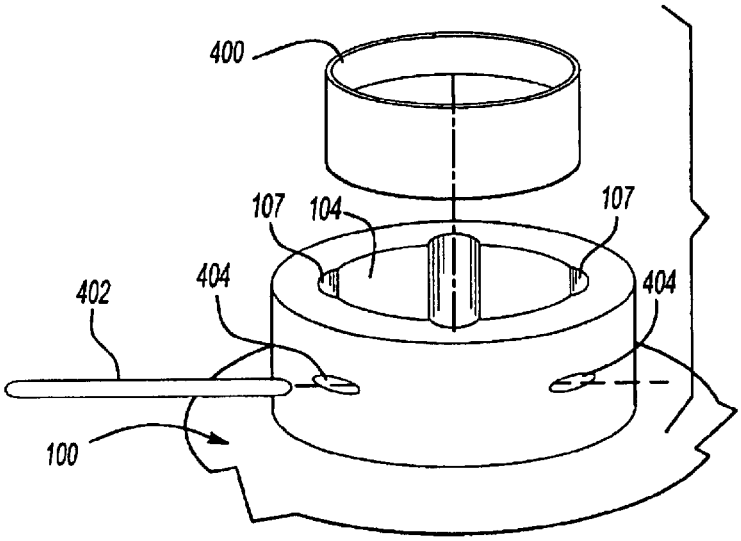
FIG. 4 illustrates a further embodiment of the inventive check valve retainer.
Figure 5:
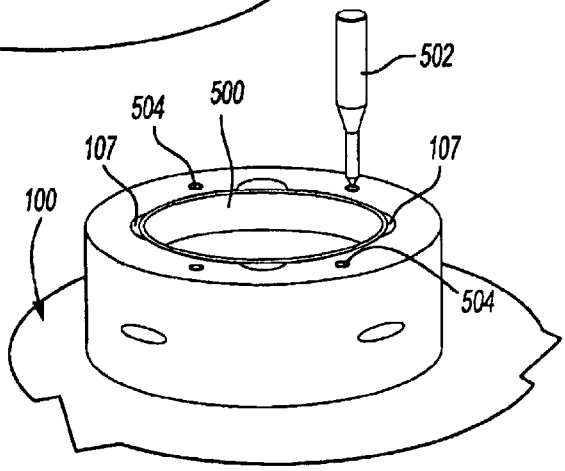
FIG. 5 illustrates yet another embodiment of the inventive check valve retainer.
Figure 6:
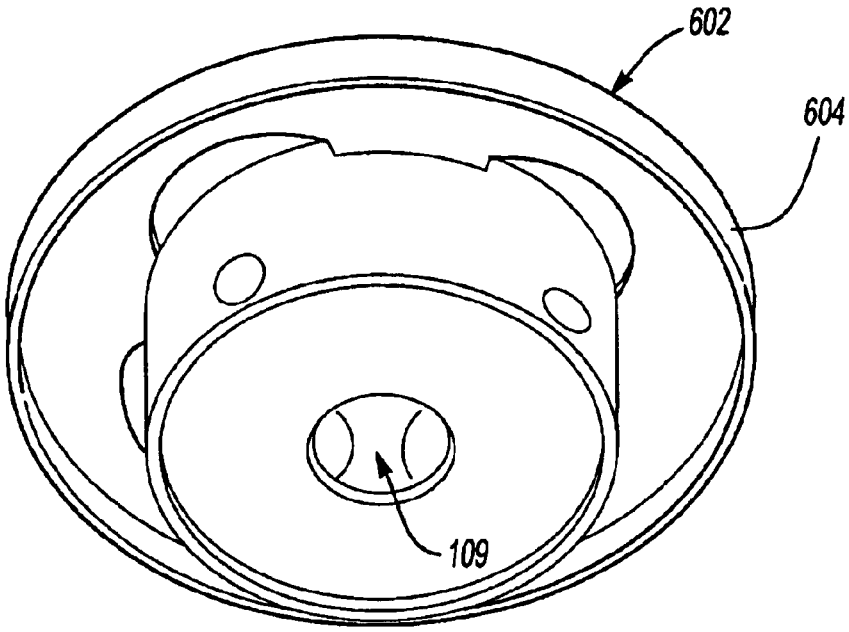
FIGS. 6 and 7 illustrate a further embodiment of the inventive check valve retainer.

FIGS. 4 through 6 illustrate alternative embodiments that incorporate retention interfaces other than a retaining lip and recess structure inside the cavity. FIG. 4 illustrates a check valve retainer 400 that is placed inside the discharge cavity 104 and held in place by a retaining pin 402 inserted through holes 404 in the scroll 100. In one embodiment, the retaining pin 402 wedges itself against the check valve retainer 400 to create an interference fit. As a result, the retainer 400 itself does not need to be machined to form an interference fit itself inside the cavity 104.

FIG. 5 illustrates another embodiment of the invention. In this embodiment, an interference fit between the retainer 500 and the inside of the discharge cavity may also be formed by placing a staking pin 502 on the scroll 100 after a retainer 500 has been inserted into the cavity 104 and imparting a blow to the staking pin 502 to deform the scroll 100 slightly to hold the retainer 500 in place through an interference fit. More particularly, the staking pin 502 forms one or more staked points 504 when struck, pushing the scroll 100 material downward and inward against the retainer 500. Like the embodiment in FIG. 4, this embodiment creates an interference fit for the retainer 500 after the retainer 500 has been inserted into the cavity 104.

Figure 7:
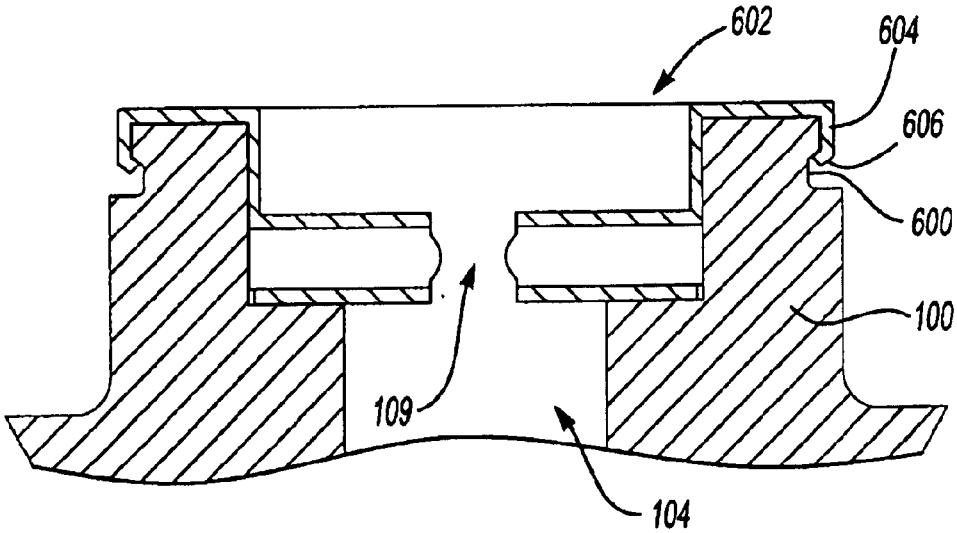

FIGS. 6 and 7 illustrate yet another possible embodiment of the invention. In this embodiment, the scroll 100 has a groove 600 formed on an outer wall of the discharge cavity 104 and the check valve retainer 602 is formed with a flange 604. During assembly, the check valve retainer 602 is inserted into the cavity 104 with the flange 604 disposed outside of the cavity 104. The flange 604 is then crimped or rolled into the groove 600 to form a lip 606 that engages with the groove 600, holding the retainer 602 in place. This embodiment makes it easy to deform the retainer 602 without requiring any modification of the inside of the cavity 104.

As a result, one embodiment of the inventive structure incorporates a recess in an inner wall of the discharge cavity and a complementary retaining lip in the check valve retainer to hold the check valve retainer in place. The retaining lip can either be formed as a integral part of the check valve retainer during manufacturing (allowing the retainer to be press fit into the cavity) or by forcing an expansion fit member having a protrusion into the check valve retainer, deforming a portion of the check valve retainer to form the retaining lip. The retaining lip keeps the check valve retainer in place without relying upon an interference fit that may distort the non-orbiting scroll or not provide enough retention force. Other embodiments of the invention include deforming the scroll and/or the check valve retainer after they are coupled together to form an interference fit or other gripped fit between the two components.

Although preferred embodiments of this invention have been disclosed, a worker of ordinary skill in the art would recognize that certain modifications would come within the scope of this invention. For that reason, the following claims should be studied to determine the true scope and content of this invention.

What is claimed is:

1. A scroll compressor, comprising:

a first scroll including a base and scroll wrap extending from said base;

a second scroll including a base and a scroll wrap extending from said base, said scroll wraps of said first and second scrolls interfitting to define a plurality of compression chambers;

a discharge cavity formed in the first scroll;

a recess formed within the discharge cavity;

a valve member movably disposed in the discharge cavity; and a check valve retainer having a retainer lip that engages the recess in the discharge cavity; and a locking member coupled to the check valve retainer, wherein the locking member is an expansion fit member having a protrusion corresponding to the recess, wherein the expansion fit member forms the retainer lip by pushing a portion of the check valve retainer into the recess.

2. The scroll compressor of claim 1, wherein the first scroll is a non-orbiting scroll.

* * * * *